United States Patent [19]

Snow et al.

[11] 3,967,908

[45] July 6, 1976

[54] CROSS TIE SADDLE BRACKET

[76] Inventors: Kenneth T. Snow, 1303 N. Cross St., Wheaton, Ill. 60187; Kenneth T. Snow, Jr., 317 Shagbark Court, Schaumburg, Ill. 60172

[22] Filed: Apr. 21, 1975

[21] Appl. No.: 569,680

[52] U.S. Cl. ..... 403/219; 403/231

[51] Int. Cl.[2] ..... F16B 5/00

[58] Field of Search ..... 403/219, 231, 232, 189, 403/190, 403, 406; 52/751, 752, 753 L, 702, 712, 92, 289

[56] References Cited

UNITED STATES PATENTS

| | | | |
|---|---|---|---|
| 974,606 | 11/1910 | Schrader | 403/219 |
| 2,902,951 | 9/1959 | Maag | 52/751 X |
| 2,911,022 | 11/1959 | Brown | 52/752 X |
| 3,537,221 | 11/1970 | Helfman et al. | 52/751 X |

FOREIGN PATENTS OR APPLICATIONS

| | | | |
|---|---|---|---|
| 541,506 | 5/1957 | Canada | 52/752 |

*Primary Examiner*—Wayne L. Shedd
*Attorney, Agent, or Firm*—Kenneth T. Snow

[57] ABSTRACT

A weld fabricated steel saddle bracket having an elongated angle member with a portion thereof adapted to abut the side of the top wall plate of a building and another portion thereof adapted to lie on the top of the top wall plate and two identical right angle members having horizontal portions welded to the top portion of the elongated angle member so that the side edges thereof are in planar alignment with the side portion of the elongated member and the ends thereof lie flush with the ends of the elongated member, and the two identical right angle members having vertical portions projecting upwardly in parallel spaced apart relationship from the top surface of the top wall plate to form a saddle to receive the cross tie members and roof rafters of the building.

1 Claim, 5 Drawing Figures

Fig. 1.
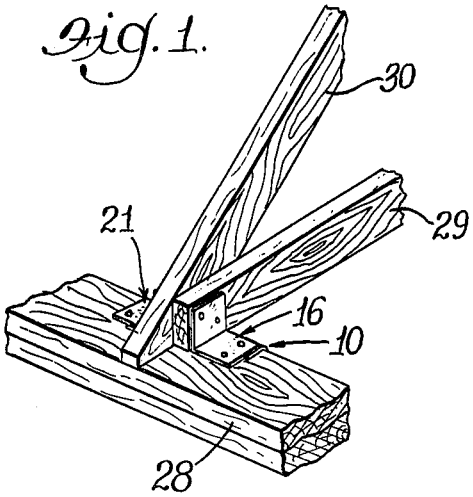
Fig. 2.
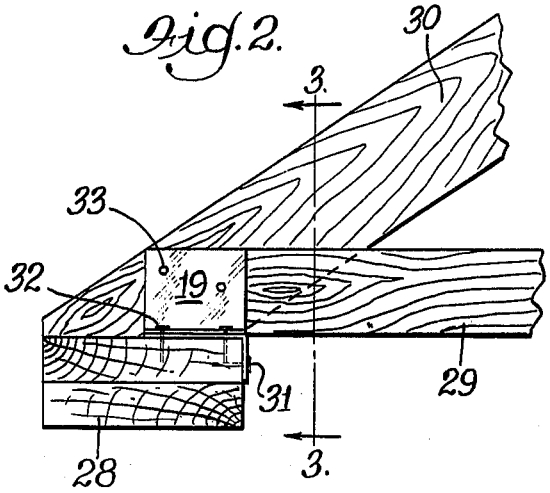
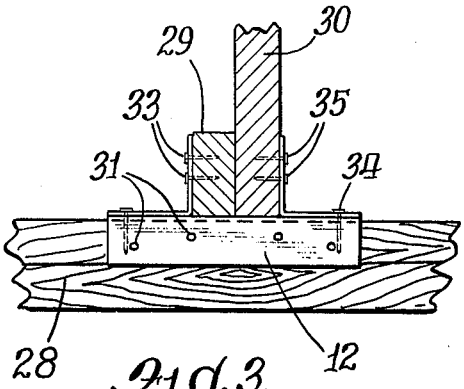
Fig. 3.
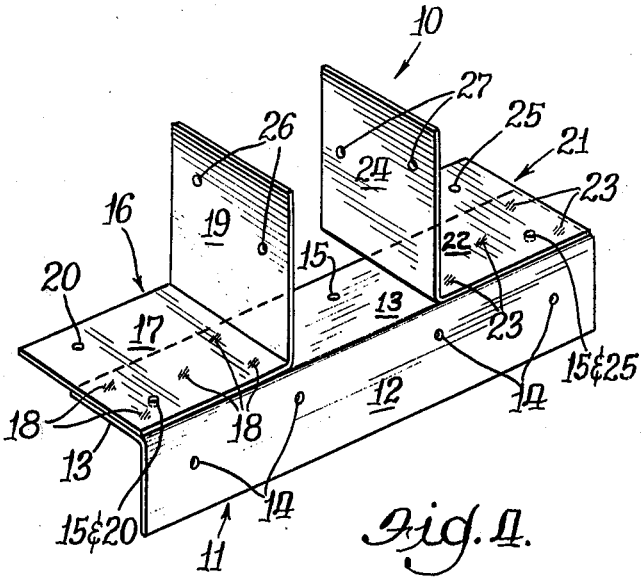
Fig. 4.
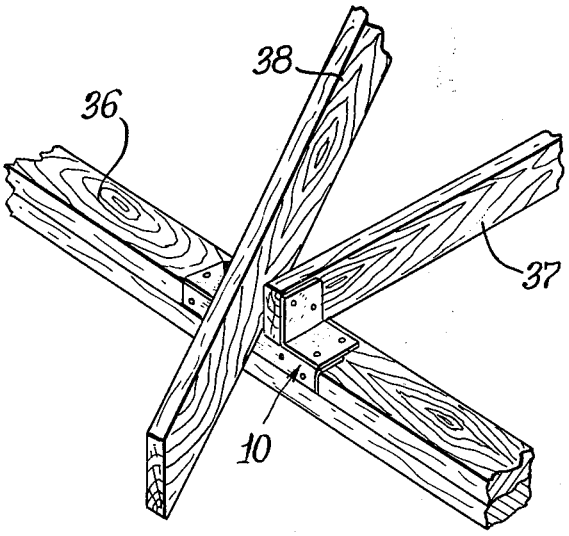
Fig. 5.

CROSS TIE SADDLE BRACKET

BACKGROUND OF THE INVENTION

The carrying of building trusses on the top plates of spaced apart wells is an important factor in the construction of a building. This is true whether the truss be a single plane truss or an offset plane truss. Normally the ends of most trusses just sit on top of the spaced apart walls and a simple toenailing is done with a nail driven through a side or an end of the truss down into the top wall plate. This practice provides no real means of holding the roof truss to the walls. Wind storms with an upward lift have no difficulty separating the roof from the walls of such a building. Also, snow loads on the roof of such a building could easily cause an outward separation of the truss or at least the roof rafters of the truss from the building walls.

Despite the fact certain framing anchors are available the normal procedure for a builder is just to use toenailing. Why? Because the eaves of a building are usually boxed in so that the ultimate buyer does not know how the building is actually constructed. The buyer only finds that out after his home is subjected to the elements and he quickly loses his roof. Even the available framing anchors are not adequate reinforcement for the heel joints of roof trusses — they amount to little more than a tie strap between roof rafter and top plate.

The present invention provides a bracket which is securely locked to the top and sides of a wall plate and is equipped with a saddle to fixedly nest the single or double width roof truss therein to provide an immovable heel joint and a non-separable wall and roof. There are no comparable saddle brackets in the prior art. applicants do, however, have their own corner bracket with a hip rafter saddle as shown in their pending patent application, Ser. No. 400,009.

SUMMARY OF THE INVENTION

A principal object of this invention is to provide a novel cross tie saddle bracket for roof trusses.

An important object of this invention is to provide a novel bracket which has a depending skirt extending for a substantial length along the inside of a top building wall plate, a top flange integrally joined to the skirt at right angles thereto and extending for a substantial length along the top of the building wall plate, and a pair of spaced apart angle members integrally joined with the top flange and provided with a top plate surface engagement beyond the flange and having spaced apart vertical walls together with the top flange forming a saddle for the single or double width ends of a roof truss.

Other and further important objects and advantages will become apparent from the disclosures in the following specification and in the accompanying drawings.

IN THE DRAWINGS

FIG. 1 is a perspective view of the bracket of this invention incorporated in the joining of a ceiling joist, a roof rafter, and a top wall plate.

FIG. 2 is a transverse sectional view taken through the top wall plate and showing the ceiling joist and roof rafter in elevation and secured in the saddle of the adjoining bracket.

FIG. 3 is a sectional view taken on the line 3—3 of FIG. 2.

FIG. 4 is a perspective view of the Cross Tie Saddle Bracket of this invention.

FIG. 5 is a perspective view of a modification of the application of the bracket of this invention in that the bracket is shown attached to the outside of the top wall plate instead of to the inner side of the top wall plate as in FIG. 1.

AS SHOWN IN THE DRAWINGS

The reference numeral 10 indicates generally the cross tie saddle bracket of this invention which is best shown in FIG. 4. The bracket includes an elongated angle member 11 having a vertical side portion 12 and a top horizontal portion 13. The side and top portions of the elongated member are preferably of the same size so that the member 11 is bent substantially on its longitudinal center line. Thus the resultant extent of each side and top portion is substantially the same or slightly greater than the thickness of 2 inch nominal size lumber. As a rule the top wall plates are usually made of two thicknesses of 2 inch lumber and thus the shorter length of the side portion 12 will cover just one of these plates and in the event only one thickness of top plate is employed the bracket will work equally well. The width of a top wall plate varies from builder to builder, some using 4 inch width, some 6 inch width and so on up to much larger sizes, such as 10 inch widths. Here the top horizontal portion 13 of the bracket extends inwardly over the top plate only the distance equal to or slightly greater than 2 inch nominal size lumber and leaving the balance of the wood exposed. This is important as the ceiling joist of the building and its roof rafter are supported jointly on a metal and wood surface. Such a combination support tends to make a silent joint and of course permits nailing, if desired, directly from wood to wood.

The vertical side portion 12 of the elongated angle member is provided with a series of holes 14 in strategically placed positions therealong to enable nails to be driven therethrough into the inside surface of the top wall plate as shown in FIGS. 2 and 3. Similarly the top horizontal portion 13 of the elongated member 11 is provided with holes 15 at spaced apart positions along the length of that portion.

A first right angle member 16 has a horizontal flat portion 17 which is weldably attached at 18 to the top portion 13 of the elongated angle member. The width of the first angle member 16 is substantially the size of 4 inch nominal lumber or just twice as great as each of the side and top portions 12 and 13 of the angle member 11. The weld attachment is such that one side edge of the horizontal flat portion is in planar alignment with the vertical side 12 of the elongated member and the end thereof is substantially flush with the end of the elongated angle member. The first right angle member 16 includes a generally vertically disposed portion 19 which extends upwardly from the top 13 of the elongated angle member 11. The horizontal portion 17 is provided with strategically placed holes 20 so that at least one such hole is in alignment with one of the holes 15 in the top 13 of the elongated member. This insures that in addition to the weld joining of the first angle member 16 to the elongated angle member 11 the two members are further joined by nails passing through the vertically aligned holes 15 and 20.

A second right angle 21 has a horizontal flat portion 22 which is weldably attached at 23 to the top portion 13 of the elongated angle member 11. The width of the second angle member 21 is substantially the size of four inch nominal lumber or just twice as great as each of the side and top portions 12 and 13 of the angle member 11 and identical to the width of the first angle member 16. The weld attachment 23 is such that one side edge of the horizontal flat portion 22 is in planar alignment with the vertical side 12 of the elongated member 11 and the end thereof is substantially flush with the end of the elongated angle member 11. The second right angle member 21 includes a generally vertically disposed portion 24 which extends upwardly from the top 13 of the elongated angle member 11. The horizontal portion 22 is provided with strategically placed holes 25 so that at least one of such holes is in vertical alignment with one of the holes 15 in the top 13 of the elongated angle member 11. As in the case of the horizontal portion 17 this alignment of at least one of the holes 15 with the holes 25 insures that a nail passing therethrough acts to join the second right angle member 21 to the elongated angle member 11 to thus supplement the weld attachments 23 which hold these two members together. In both horizontal flat portions 17 and 22 at least one of their respective holes 20 and 25 are spaced from the aligned holes 15 and 20, and 15 and 25 so that attaching nails only go through the one thickness of metal and into the wood to which the bracket of this invention is to be fastened.

The vertical portion 19 of the first right angle member 16 is provided with nail holes 26 and similarly the vertical portion 24 of the second right angle member 21 is provided with nail holes 27. It should be noticed that the holes 26 and 27 are disposed so that they are not in direct alignment with one another. It is these two vertical members 19 and 24 which together form the sides of a saddle to receive cross tie members and thus when nails are driven into the cross tie members from opposite sides through the holes 26 and 27 the nails do not interfere with one another.

The application of this cross tie saddle bracket to a building is shown more particularly in FIGS. 1, 2, 3 and 5. In FIG. 1 the top plate of a wall is shown at 28 and comprises two superposed planks of 2 inch thick nominal lumber. These top plate planks may be of any desired width and still accommodate the bracket of this invention. The planks of FIGS. 1 and 2 are much wider than four inch wide nominal lumber as evidenced by the fact the bracket 10 falls far short of covering the width of that top plate. A ceiling joist 29 is adapted to be received in the saddle and having its bottom side resting on the top 13 of the elongated angle member 11 and on the wood of the top plate 28. A roof rafter 30 is also carried in the saddle formed by the top 13 of the elongated angle member 11 and the parallel spaced apart vertical portions 19 and 24 of the first and second angle members 16 and 21 respectively. Thus the ceiling joist 29 and roof rafter 30 are carried in side-by-side relationship between the vertical members 19 and 24. Nails 31 are driven through the holes 14 in the vertical side 12 of the elongated angle member 11 to hold the bracket to the inside of the top wall plate 28. Nails 32 are driven through the holes 15 and the combined holes 15 and 20, to further hold the bracket to the top side of the top wall plate 28. Nails 33 are driven through holes 26 to engage the side of the ceiling joist 29. Nails 34 are driven through combined holes 15 and 25 to hold the other end of the bracket to the top side of the top wall plate 28. Nails 35 are driven through the holes 27 to engage the side of the roof rafter 30. Thus the bracket

10 is now securely locked to the top plate 28 by nails disposed both vertically and horizontally. Also, the side-by-side ceiling joist 29 and roof rafter 30 are locked in the bracket saddle to thus securely fasten those offset members of the building cross-tie members to the top plate 28 of the building well. It should be understood the bracket of this invention can be made with a saddle of only a single plank opening in the event a truss of a single plane is employed to support the building roof and tie the building roof to spaced apart walls.

It is preferable to fasten the saddle bracket of this invention to the insides of the building wall top plates to gain the most strength of this bracket as the heel support of the roof truss as shown herein. However, as shown in FIG. 5 the saddle bracket may be mounted on the outside of the building wall top plates 36 and still lockingly support a ceiling joist 37 and an upwardly inclined roof rafter 38.

We are aware that numerous details of construction may be varied throughout a wide range without departing from the principles disclosed herein and we therefore do not propose limiting the patent granted hereon otherwise than as necessitated by the appended claims.

What is claimed is:

1. A cross-tie saddle bracket comprising an elongated L-shaped member having a horizontal top portion and a vertical side portion of substantially the width of 2 inch nominal lumber, said elongated L-shaped member having a plurality of holes in both its horizontal top portion and its vertical side portion, a first L-shaped member having its width substantially the width of 4 inch nominal lumber and having a horizontally disposed side and a vertically disposed side, the outer end of the horizontal side of said first L-shaped member lying flush with one end of the horizontal top portion of said elongated L-shaped member and welded thereto in a manner so that one side edge of the horizontal side is substantially flush with the vertical side portion of the elongated L-shaped member and the other side edge overhangs the surface of the horizontal top portion by an amount substantially the width of 2 inch nominal lumber, and a spaced apart identical second L-shaped member having the end of the horizontal side thereof lying flush with the other end of said elongated L-shaped member and one side edge thereof being-substantially flush with the vertical side portion of the elongated L-shaped member and the other side edge overhanging the surface of the horizontal top portion by an amount substantially the width of 2 inch nominal lumber, and the second L-shaped member welded to said horizontal top portion of the elongated L-shaped member in the same manner as the first L-shaped member, said vertical sides of said first and second L-shaped members being spaced apart and disposed generally parallel to each other, said first and second L-shaped members having holes in both the horizontal and vertical sides with at least one hole of the horizontal sides being in alignment with at least one hole in the horizontal top portion of the elongated L-shaped member, whereby the elongated L-shaped member is adapted to have its vertical side portion abut and be nailed through the holes therein to the side of the top wooden wall plate of a building, and the horizontal top portion of the elongated L-shaped member and its superimposed horizontal sides of the first and second L-shaped members thereon are adapted to be jointly nailed to the top of the top wooden wall plate and the overhanging portions of the horizontal side portions are adapted to be separately nailed directly to the top wooden wall plate, and the spaced apart vertical sides of the first and second L-shaped members are adapted to act as a saddle for building cross tie members and are adapted to have nails driven through the holes therein to the cross tie members to thus provide for the secure locking of the wall plate to the cross tie members.

* * * * *